US010448666B1

(12) United States Patent
Holloway

(10) Patent No.: US 10,448,666 B1
(45) Date of Patent: Oct. 22, 2019

(54) PERSONAL TOBACCO CONTAINMENT AND AUTO LOADING SMOKING APPARATUS

(71) Applicant: Terry Holloway, Tahlequah, OK (US)

(72) Inventor: Terry Holloway, Tahlequah, OK (US)

( * ) Notice: Subject to any disclaimer, the term of this patent is extended or adjusted under 35 U.S.C. 154(b) by 319 days.

(21) Appl. No.: 15/434,908

(22) Filed: Feb. 16, 2017

Related U.S. Application Data

(60) Provisional application No. 62/295,574, filed on Feb. 16, 2016.

(51) Int. Cl.
*A24F 1/26* (2006.01)
*A24F 3/00* (2006.01)

(52) U.S. Cl.
CPC . *A24F 1/26* (2013.01); *A24F 3/00* (2013.01)

(58) Field of Classification Search
None
See application file for complete search history.

(56) References Cited

U.S. PATENT DOCUMENTS 1,053,039 A * 2/1913 Karnes ..... A24F 1/00 131/176
2,303,167 A 11/1942 Loether
3,524,535 A 8/1970 Dundore
4,167,238 A 9/1979 Koski
4,223,687 A 9/1980 Sandeen
4,484,590 A 11/1984 Singh
5,456,269 A 10/1995 Kollasch
5,832,935 A 11/1998 Heine
5,967,312 A 10/1999 Jacobs
6,474,342 B1 11/2002 Rennecamp
7,717,259 B2 5/2010 Hatton
8,590,540 B2 11/2013 Kahn, III
8,881,738 B2 11/2014 Bryman
2002/0088469 A1* 7/2002 Rennecannp ..... A24F 1/00 131/330

OTHER PUBLICATIONS www.grasscity.com, "Handmade Wood Double Dugout with Two Digger One-Hitter Pipe".
www.token-pipes.myshopify.com, "Token/Savorette Pipes".
www.zamnesia.com, "Zamnesia Wooden Pipe Sneaky Teaky".

* cited by examiner

*Primary Examiner* — Dennis R Cordray
(74) *Attorney, Agent, or Firm* — James F. Lea, III; Gable Gotwals

(57) ABSTRACT

A smoking device that provides a convenient way to store, carry, load, and smoke tobacco and/or herbal products. Components are enclosed in a unit that provides a quick delivery of product from a storage chamber to an ignition chamber, where the product can be ignited with a flame source or heating element. The device has a body that defines an opening that provides access to one or more storage chambers, an ignition chamber, and a mover passageway. A mover, such as an auger, is located in the mover passageway for moving product from a storage chamber to the ignition chamber. The mover may be activated from outside the body. The body includes air passageway that connects the ignition chamber to an outside of the body for venting smoke. A cover is received in the opening for selectively covering the storage chamber and ignition chamber.

11 Claims, 3 Drawing Sheets

PERSONAL TOBACCO CONTAINMENT AND AUTO LOADING SMOKING APPARATUS

CROSS REFERENCE TO RELATED APPLICATIONS

This application claims the priority of U.S. Provisional Patent Application No. 62/295,574 entitled "PERSONAL TOBACCO CONTAINMENT AND AUTO LOADING SMOKING APPARATUS," filed Feb. 16, 2016, the contents of which are hereby incorporated by reference.

FIELD OF THE INVENTION

The present invention is in the field of smoking accessories for tobacco and herbs. More particularly, the present invention is in the field of a smoking accessory that stores smoking material, allows for smoking the smoking material, and allows a user to load an ignition chamber by externally actuating a product mover within the smoking accessory.

BACKGROUND OF THE INVENTION

Typical smoking accessories are a burden to carry around upon your person due to the bulkiness of pipes and tobacco and/or herbal products. Typical smoking accessories may require a lengthy set of steps to operate or to achieve desired results. For example, U.S. Pat. No. 4,214,658 for "Smoking System" teaches a quick and efficient method to fill a pipe with smoking material. However, after the storage cavity is initially loaded with material, the user must perform nine steps: i.e., pull out of pocket, slide lid over to expose pipe, pull pipe out, slide lid other direction, insert pipe into other cavity to load material, close lid, place back in pocket, and then ignite the pipe with a flame source. It would then take the user an additional five steps to replace the pipe in its cavity or receptacle and back in the user's pocket.

SUMMARY OF THE INVENTION

The present invention is a compact, convenient smoking device for storing, carrying, loading, and smoking tobacco and/or herbal products. The device has a body that defines a storage chamber, an ignition chamber, a mover in a mover passageway for transporting material from the storage chamber to the ignition chamber. An external knob is affixed to the mover for allowing a user to manipulate the mover. A mouthpiece may be defined by the first side of the body.

An air passageway communicates the ignition chamber and an exterior of the body, such as the mouthpiece. Edges of the opening on the top of the body define tracks that receive a slidable cover that is received in tracks.

The smoking device has a body having a top that defines an opening having a first edge and a second edge. The body has a bottom, a first side, a second side, a third side and a fourth side. The body further defines an ignition chamber and a mover passageway. The mover passageway has a first end proximate the second side of the body. The mover passageway has a second end proximate the ignition chamber. A mover is located in the mover passageway. The mover defines a first end and a second end. The first end is proximate to the second side of the body. The second end is proximate to the ignition chamber.

The body defines at least one storage chamber. The storage chamber has a side adjacent to the mover passageway. The side defines an aperture. The mover defines an interface, such as threads, for transferring material from the storage chamber to the ignition chamber. The threads may be longer than the side of said storage chamber. A knob is affixed to the second end of the mover for allowing a user to manipulate the mover. A bushing may be provided between the knob and the second side of the body.

The mouthpiece is defined by the first side of the body. The body further defines an air passageway. The air passageway has a first end in communication with the ignition chamber. The air passageway has a second end in communication with the mouthpiece. The first edge of the opening on the top of the body may define a first track. The second edge of the opening on the top of the body may defines a second track. A cover has a top, a bottom, a first side, a second side, a third side, and a fourth side. The first side for slidably engaging the first track. The third side for slidably engaging the second track. The first side and third side of the cover may further define a longitudinal groove.

The present invention provides a more convenient way to store, carry, load, and smoke desired tobacco and/or herbal products. All components are enclosed in one self-contained unit that provides a quick delivery of tobacco and/or herbal product from a storage chamber to an ignition chamber, where the product can then be ignited with a flame source or heating element within seconds. The pipe of the present invention solves issues associated with previous pipes by housing a mover, such as an auger, that when exposed to tobacco and/or herbal products within the storage chamber, may be used to load smoking materials into an ignition chamber. The present invention is compact and eliminates many of the steps required by other pipes, which makes the pipe of the invention more convenient and efficient.

DETAILED DESCRIPTION OF THE PREFERRED EMBODIMENTS

Figure 1:
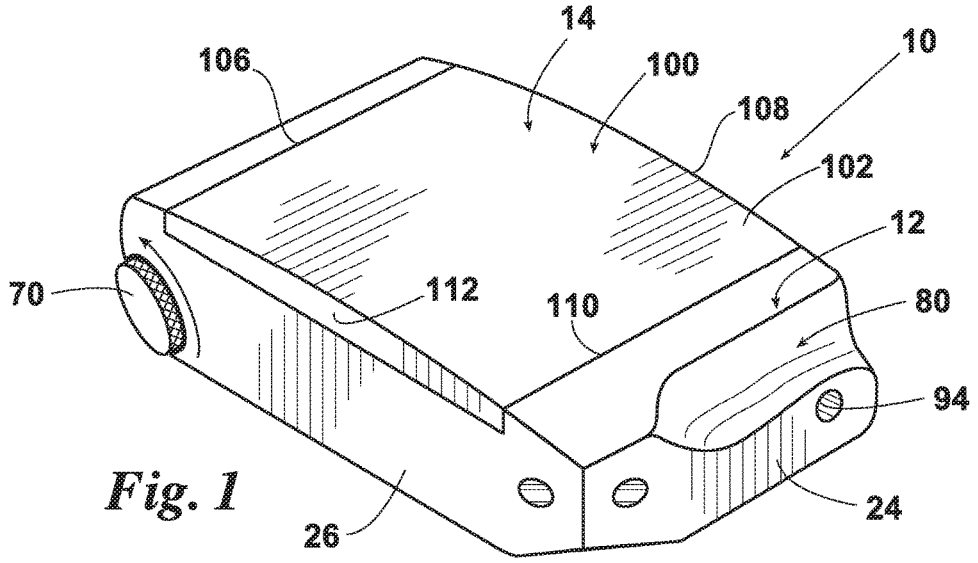
FIG. 1 is a perspective view of the device of the present invention.
Figure 2:
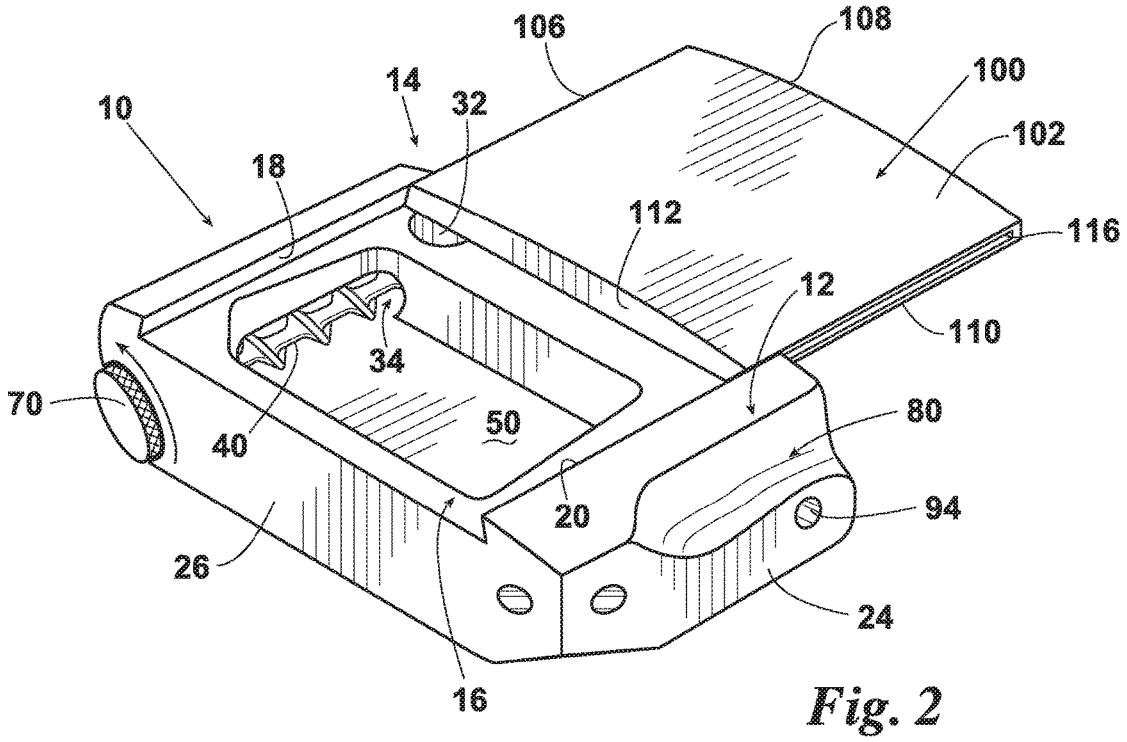
FIG. 2 is a perspective view of the device of FIG. 1 wherein the cover is opened.
Figure 3:
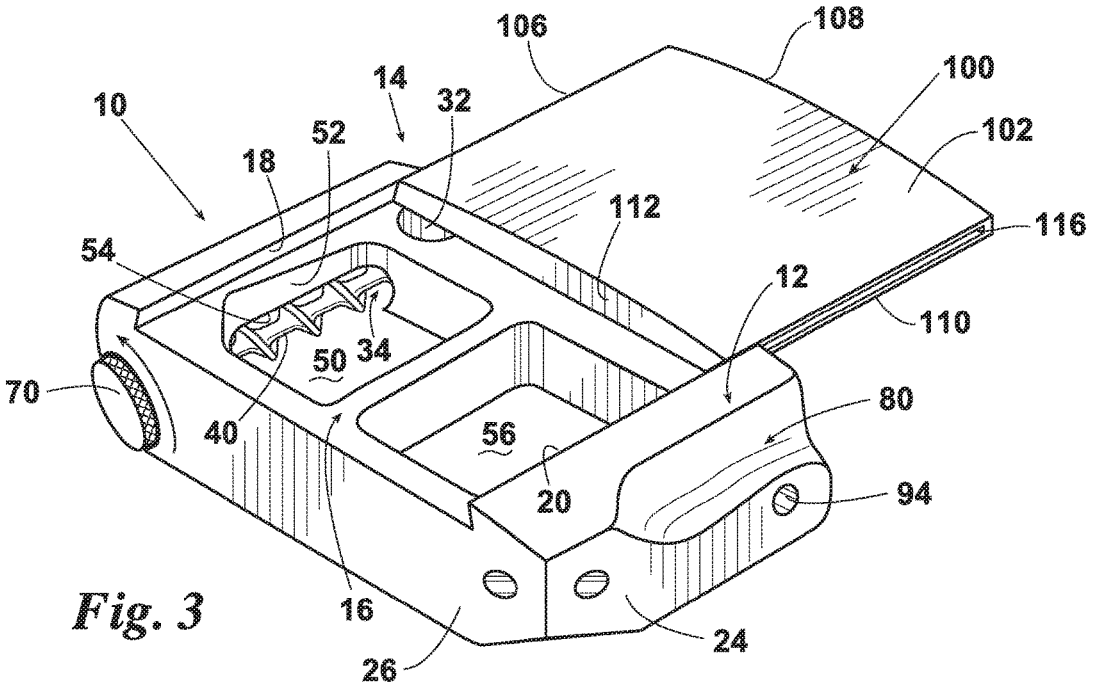
FIG. 3 is a perspective view of a second embodiment of the device of the invention.
Figure 4:
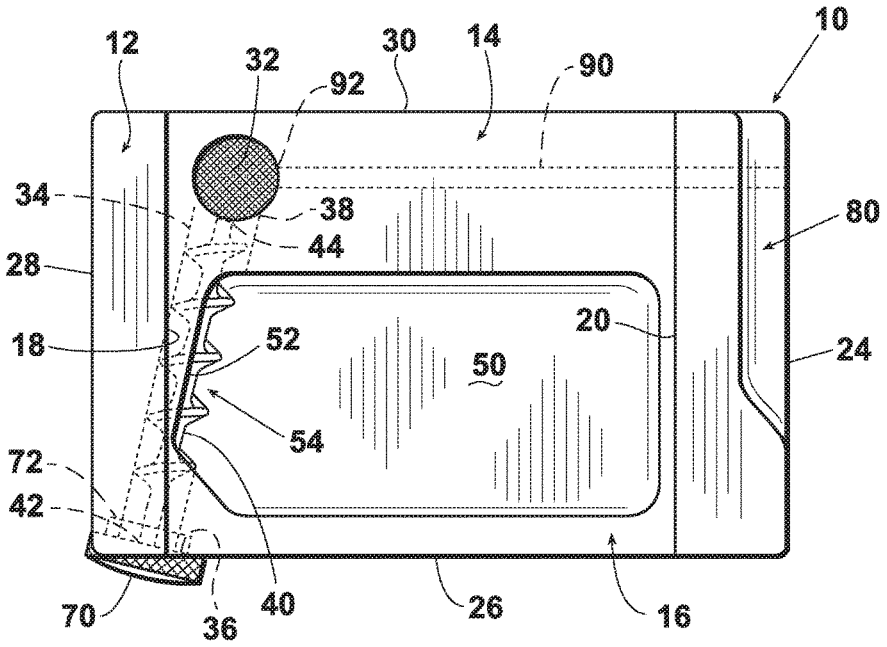
FIG. 4 is a plan view of the device of FIG. 2.

Referring to FIGS. 1 through 6, shown is smoking device 10. Smoking device 10 has body 12. Body 12 has top 14 defining opening 16 (FIGS. 2-4). Opening 16 has a first edge 18 and a second edge 20. Body 12 has bottom surface 22, first side 24, second side 26, third side 28, and fourth side 30.

Body 12 defines ignition chamber 32. Body 12 also defines mover passageway 34. Mover passageway 34 has first end 36 proximate second side 26 of body 12. Mover passageway 34 (FIGS. 2-4) has second end 38 (FIG. 4) proximate to ignition chamber 32.

Mover 40 is located in mover passageway 34. Mover 40 has first end 42 and second end 44. First end 42 of mover 40 is proximate to second side 26 of body 12. Second end 44 is proximate to ignition chamber 32. Body 12 further defines storage chamber 50. Storage chamber 50 has side 52 adjacent mover passageway 34. Side 52 defines aperture 54.

In one embodiment, body 12 defines storage chamber 50, as described above, and also defines auxiliary storage chamber 56 (FIG. 3).

Figure 8:
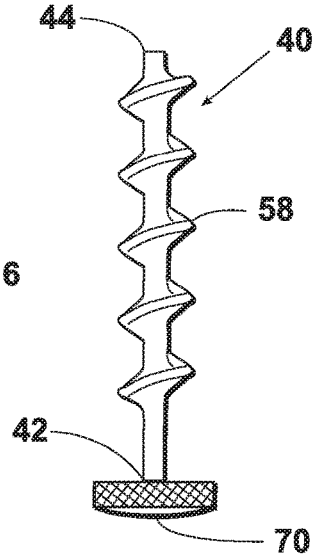
FIG. 8 is a plan view of the mover of the device of FIGS. 1 and 3.

Referring now to FIG. 8, in one embodiment, mover 40 defines an interface 58 for transferring material from storage chamber 50 to ignition chamber 32. In one embodiment, mover 40 is an auger and interface 58 is threads 60. Threads 60 may be longer than side 52 of storage chamber 50.

Knob 70 is affixed to first end 44 of mover 40. Knob 70 facilitates the manipulation of mover 40 by a user. In a preferred embodiment, bushing 72 (FIG. 4) is positioned between knob 70 and body 12 proximate second side 26 of body 12.

In one embodiment, mouthpiece 80 is provided on first side 24 of body 12.

Body 12 defines air passageway 90. Air passageway 90 has first end 92 in communication with ignition chamber 32. Air passageway 90 has second end 94 in communication with first side 26 of body 12. Second end 94 of air passageway 90 may communicate with mouth piece 80.

Figure 5:
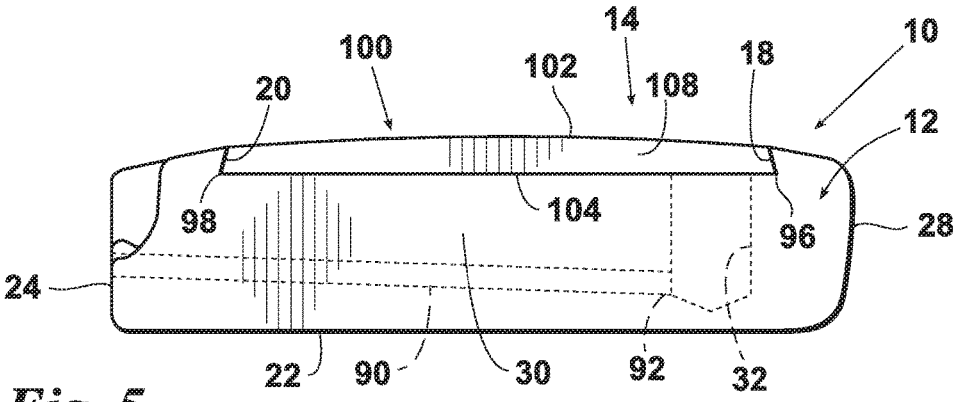
FIG. 5 is a left side view of the device of FIG. 2.
Figure 6:
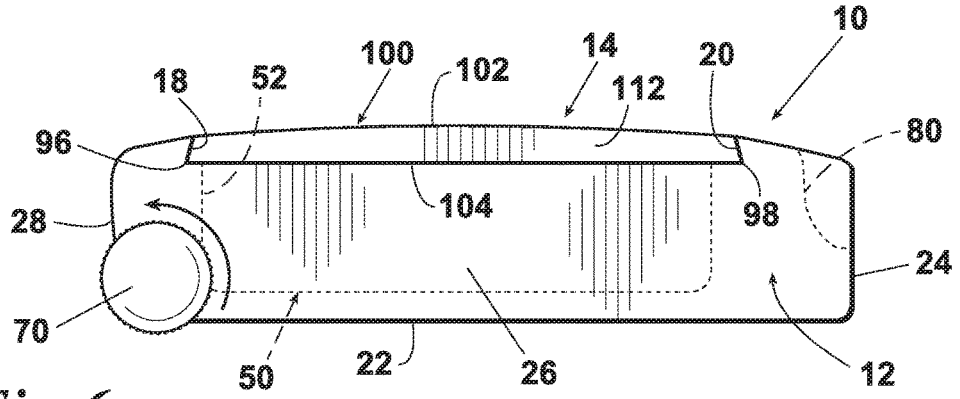
FIG. 6 is a right side view of the device of FIG. 2.
Figure 7:
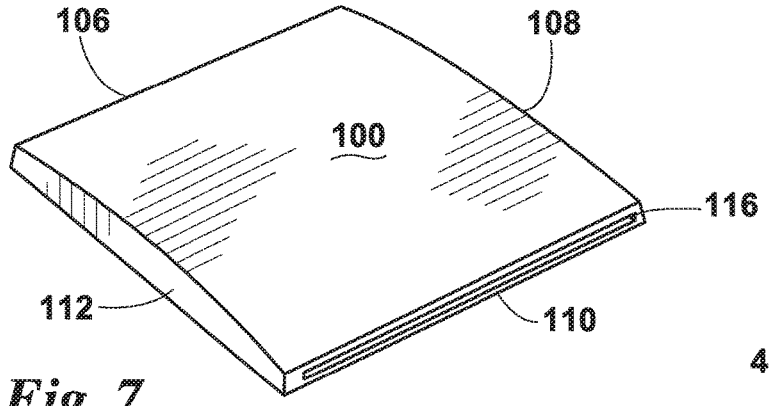
FIG. 7 is a perspective view of the cover of FIG. 2.

Referring to FIGS. 5 and 6, first edge 18 of opening 16 on top 14 of body 12 defines first track 96. Second edge 20 of opening 16 on top 14 of body 12 defines second track 98.

Cover 100 has top 102, bottom 104, first side 106, second side 108, third side 110, and fourth side 112. First side 106 is for slidably engaging first track 96. Third side 110 is for slidably engaging second track 98. First side 106 of cover 100 defines first longitudinal groove 114 (not shown). Third side 110 of cover 100 further defines second longitudinal groove 116.

As discussed above, a tobacco and/or herbal product pipe 10 that defines storage chamber 50. Mover 40, such as an auger, is attached to knob 70. Knob 70 is preferably knurled for facilitating ease of turning by a user. Bushing 72 is preferably provided therebetween. Pipe 10 includes mover passageway 34. Mover passageway 34 communicates with storage chamber 50 and ignition chamber 32. The mover 40 is located within mover passageway 34. In one embodiment, mover 40 is longer than the width of storage chamber 50. In one embodiment, a width of storage chamber 50 is 1⅜", while a length of threads on the auger that functions as mover 40 is 1⅝". Mover 40 preferably extends into or adjacent to ignition chamber 32. Pipe 10 further includes air passageway 90 that communicates ignition chamber 32 to first external side 24 of pipe 10. First external side 24 defines mouth piece 80. Ignition chamber 32 communicates with air passageway 90 at a first end and communicates with the mouth piece 80 at a second end. Pipe 10 and all components therein are enclosed and secured inside pipe 10 by cover 100 (FIG. 2), which may be a sliding lid.

Still referring to FIGS. 1-6, pipe 10 defines storage chamber 50 for receiving and storing tobacco and/or herbal products until consumption. Mover 40 is located within the pipe 10 and communicates with storage chamber 50. Mover 40 allows for and controls movement of tobacco and/or herbal products into ignition chamber 32 by turning or twisting knob 70. Knob 70 is located on the outside of second external side 26 of pipe 10 and is fixed in place by a bushing 72. Bushing 72 allows for turning movement of mover 40. Mouthpiece 80 is used to draw tobacco and/or herbal byproducts (smoke) through the air passageway 90 from ignition chamber 32 into the users' mouth when the product in ignition chamber 32 is lit by a flame source or heating element. Storage chamber 50 and all contents are enclosed and secured by cover 100 (FIG. 2). In one embodiment, cover 100 is slid to the side in one direction to allow access to storage chamber 50 and cover 100 may be slid the opposite direction to access the ignition chamber 32.

Pipe 10, or any component therein, may be constructed of wood products or of any other material that is suitable to provide desirable results, such as, but not limited to any metal, plastic, wood, glass, clay, granite, marble, ceramic, or any other elements, minerals, and compounds, or any combination of materials thereof.

Further, the shape, design, and dimensions of the pipe 10 shown in the figures, may vary and shall not be limited to a rectangular shape, but shall include other shapes or designs as well as any dimensions deemed appropriate for design of present invention.

Mover 40 is not limited to the auger embodiment shown in the figures, but may be any mechanism that facilitates transport of materials from storage chamber 50 to ignition chamber 32.

The components of pipe 10, shown in the figures, may be oriented in alternative configurations to accommodate for design and pattern variations. The components include storage chamber 50, knob 70 with bushing 72, mover 40, ignition chamber 32, air passageway 90, and mouth piece 80.

Cover 100 is not limited to sliding side to side, but may be moved, slid, removed, opened, or closed in other ways that will function in the present invention.

Referring now primarily to FIG. 8, mover 40 is attached to knob 70, which is adjacent to bushing 72. Bushing 72 allows for twisting and turning of knob 70 and attached mover 40. Mover 40 transports tobacco products from storage chamber 50 to ignition chamber 32 (see, e.g., FIG. 4).

Mover 40 is not be limited to this particular auger type device shown in the figures, but may include a device of other size, shape, or design that will transport substances from storage chamber 50 to ignition chamber 32, with or without the use of knob 70 and bushing 72. Examples of other movers include pushers, gears, wheels, levers, springs, plungers, pokers, rods, etc., or any combination thereof.

Advantages of the present invention include, without limitation, ease of use and convenience. The pipe of the invention is functional, practical, and durable. The present invention eliminates many of the steps necessary to operate a typical pipe that is currently on the market. The present invention is compact in design which allows the user the ability to smoke on the go without the hassle of toting around excessive accessories, such as pouches of tobacco and/or herbal products and bulky pipes.

The present invention is a portable, fully functional tobacco and/or herbal product pipe that stores tobacco and/or herbal products that is auto loading with the spin of a wheel or alternative method of activating the mover. The pipe of the invention is intended to be used recreationally by members of the smoking community to enhance ease of use and convenience.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A smoking device comprising:

a body, said body having a top defining an opening having a first edge and a second edge, said body having a bottom, a first side, a second side, a third side opposite said first side and a fourth side opposite said second side wherein said first edge of said opening is adjacent said third side of said body and said second edge of said opening is adjacent said first side of said body;

said body further defining an ignition chamber;

said body defining a mover passageway, said mover passageway having a first end proximate said second side of said body, said mover passageway having a second end proximate said ignition chamber;

a mover located in said mover passageway, said mover defining a first end and a second end, said first end proximate to said second side of said body, said second end proximate said ignition chamber;

said body defining a storage chamber, said storage chamber having a side adjacent said mover passageway, said side defining an aperture;

wherein said mover defines an interface for transferring material from said storage chamber to said ignition chamber;

said body further defining an air passageway, said air passageway having a first end in communication with said ignition chamber, said air passageway having a second end exiting said first side of said body for venting smoke externally to said body;

a cover for selectively covering said storage chamber for retaining material in said storage chamber.

2. The smoking device according to claim 1 wherein:

said body defines a second storage chamber.

3. The smoking device according to claim 1 wherein:

said interface defined by said mover comprises screw threads.

4. The smoking device according to claim 3 wherein:

said screw threads extend beyond said aperture of said storage chamber.

5. The smoking device according to claim 1 wherein:

an external member communicates with said mover for allowing a user to manipulate said mover without opening said cover.

6. The smoking device according to claim 5 wherein:

said external member is a knob affixed to said first end of said mover.

7. The smoking device according to claim 6 further comprising:

a bushing between said knob and said second side of said body.

8. The smoking device according to claim 1 wherein:

said body defines a mouthpiece on said first side of said body.

9. The smoking device according to claim 8 wherein:

said second end of said air passageway communicates with said mouthpiece.

10. The smoking device according to claim 1 wherein:

said first edge of said opening on said top of said body defining a first track;

said second edge of said opening on said top of said body defining a second track;

said cover having a top, a bottom, a first side, a second side, a third side opposite said first side, and a fourth side opposite said second side, said first side for slidably engaging said first track, said third side for slidably engaging said second track.

11. The smoking device according to claim 10 wherein said first side of said cover further defines a first longitudinal groove;

wherein said third said of said cover further defines a second longitudinal groove.

* * * * *